United States Patent [19]

Hewell

[11] 4,332,204

[45] Jun. 1, 1982

[54] MERCHANDISING DISPLAY STAND

[75] Inventor: Gerald M. Hewell, Dewy Rose, Ga.

[73] Assignee: The Mead Corporation, Atlanta, Ga.

[21] Appl. No.: 151,376

[22] Filed: May 19, 1980

[51] Int. Cl.[3] ..... A47F 5/12

[52] U.S. Cl. ..... 108/1; 108/108; 211/187; 248/250

[58] Field of Search ..... 108/1, 108, 111; 211/187; 248/250

[56] References Cited

U.S. PATENT DOCUMENTS

| | | | |
|---|---|---|---|
| 820,745 | 5/1906 | Sutton | 108/1 |
| 2,834,478 | 5/1958 | Macdonald | 248/250 X |
| 2,919,034 | 12/1959 | Levy | 108/1 |
| 3,199,471 | 8/1965 | Orsi | 211/187 X |
| 3,285,428 | 11/1966 | Scheck | 211/187 |
| 3,601,256 | 8/1971 | Bowers | 211/187 |
| 4,148,263 | 4/1979 | Suttles | 108/1 |

*Primary Examiner*—Francis K. Zugel
*Attorney, Agent, or Firm*—Howson and Howson

[57] ABSTRACT

In a sheet metal merchandising display stand, a base shelf is converted from a horizontal bottle support to a tilted package support merely by reversing its position. Two reinforcing channels are secured to the underside of the shelf and extend from one side to the other. These reinforcing channels have web sections both of which are located in a plane forming a 3.5 degree angle with the article-supporting surface. The web sections rest on flanges which project inwardly from the side panels of a base assembly and are located in a plane which is 3.5 degrees from the horizontal. In one position of the shelf, the two angles add together to produce a shelf angle of seven degrees. In the other position the angles subtract to produce a shelf angle of zero degrees. A strong, light-weight tiltable shelf is provided which can be adjusted in the fore-and-aft direction.

3 Claims, 9 Drawing Figures

MERCHANDISING DISPLAY STAND

BRIEF SUMMARY OF THE INVENTION

This invention relates to merchandising display stands of the type used in self-service grocery stores and supermarkets for displaying bottled soft drinks.

In general, soft drinks are sold in self-service stores both in individual two liter bottles and in packages each of which contains a number of smaller bottles or cans. Merchants generally display the large bottles and the packages for a given brand at the same location, and in most cases they prefer to display individual bottles and packages on the same display stand. The relative proportion of individual bottles to packages, however, varies depending on purchaser demand, and also varies depending on which particular types of soft drink containers are being promoted by the bottlers at any particular time. Consequently, there are occasions on which a given display stand is devoted entirely to individual bottles, and other occasions on which the same stand is used to display individual bottles and packages together.

The practice has usually been to display individual bottles on horizontal shelves, since individual bottles have a tendency to slide on sloping shelves. Some attempts have been made to use forwardly sloping shelves for individual bottles with the object of causing the bottles to move forwardly automatically when bottles are removed from the shelves by customers. Rearwardly sloping shelves, however, are impractical for individual bottles, since they cause individual bottles to tend to slide rearwardly and out of the reach of customers.

Packaged soft drink containers present a different problem. It has been the practice to stack packages on top of each other for the most effective use of available space. Unfortunately, a stack of packages tends to be unstable. Consequently, in accordance with current practice, many display stands are provided with sloping shelves and sloping back panels to receive and accommodate these stacks of packages in such a way as to maintain stability of the stacks. Typically, the base shelf and the back panel are perpendicular to each other, and are tilted rearwardly at an angle of about seven degrees.

In his U.S. Pat. No. 4,148,263, dated Apr. 10, 1979, James Marshall Suttles describes a shelving assembly for merchandising soft drinks in individual bottles and in packages. Suttles' display stand has a plurality of horizontal shelves in its upper part for displaying individual bottles, and a tilting base and back panel for displaying stacked packages. The base assembly is convertible so that the entire stand can be used for individual bottles. To achieve conversion, the back panel is mounted horizontally to provide an additional horizontal shelf, and the sloping base panel is moved to a horizontal position to provide still another horizontal shelf. The sloping and horizontal positions of the base panel are made possible by the use of a special shelf-supporting beam at the rear of the display stand. This beam has a primary ledge for receiving the rear edge of the base panel, and maintaining the base panel in a horizontal condition, and a tilting ledge for alternatively receiving the rear edge of the base panel, and maintaining the base panel in its sloping condition.

In a merchandiser, of the type described in the Suttles patent, with a special shelf-supporting beam having primary and tilting ledges at the rear of the base, it is difficult to achieve the strength necessary in the base panel to support large stacks of packaged soft drink containers. It is also difficult to achieve fore-and-aft adjustment of the position of the sloping base panel such as may be necessary to accommodate different sizes of packages. Another problem with the special shelf-supporting beam is the fact that it is relatively complex and consequently expensive to manufacture. Expenses are further increased because of the fact that the beam must be supplied in several different lengths to accommodate shelving assemblies of different widths. Still another problem with the shelf-supporting beam is the fact that it is a separate element from the rear base member which interconnects the rear posts of the shelving assembly. It has not been considered practical to modify the shelf-support beam and use it in place of a rear base member.

One object of this invention is to provide a simple and effective means for achieving the necessary strength in a convertible base. It is also an object of this invention to provide a simple and effective means for achieving fore-and-aft adjustability of a convertible base. Still another object of the invention is to provide a convertible display stand base which is structurally simple, inexpensive to manufacture, and easily changed from its horizontal position to its tilted position.

The merchandising display stand in accordance with the invention comprises a base and a shelf providing a substantially flat article-supporting surface removably mountable on the base. The display stand is characterized by means on the base for supporting the shelf, and means on the shelf cooperable with the means on the base, for positioning the article-supporting surface in a first plane when the shelf is mounted on the base with one edge toward the front of the base, and for positioning the article-supporting surface in a second plane which intersects said first plane when the shelf is reversed and mounted on the base with the same edge toward the rear of the base.

Preferably the base comprises a pair of side panels, and the means on the base for supporting the shelf comprises a flange formed each side panel. The flange on each panel provides an upwardly facing supporting area disposed in an oblique plane. The means on the shelf cooperable with the means on the base comprises means providing downwardly facing contact areas, each disposed in a plane oblique with respect to the article-supporting surface, each downwardly facing contact area being positioned for engagement with one of the flanges when the shelf is mounted on the base with one edge toward the front of the base, and with the other of said flanges when the shelf means is reversed and mounted with the same edge toward the rear of the base.

The flanges on the side panels enable the shelf to be adjusted in the fore-and-aft direction. Tabs projecting upwardly from the flanges cooperate with slots in the downwardly facing contact areas to lock the shelf against movement in the fore-and-aft direction.

Reinforcement of the shelf is accomplished by first and second U-shaped reinforcing channels extending in directions parallel to the front and rear edges of the shelf, and secured to the underside of the shelf in spaced relationship to each other and on opposite sides of the midline between the front and rear edges. The U-shaped channels having coplanar web sections disposed in a plane oblique with respect to the article-supporting surface. The ends of these coplanar web sections provide the downwardly facing contact areas which cooperate with the flanges on the side panels to support the shelf. By using sloping flanges on the side panels of the base, and reinforcing channels extending across the underside of the shelf, reinforcement can be achieved without interfering with the fore-and-aft adjustability of the shelf.

Additional objects and advantages of the invention will be apparent from the following detailed description when read in cojunction with the drawings.

DETAILED DESCRIPTION

Figure 1:
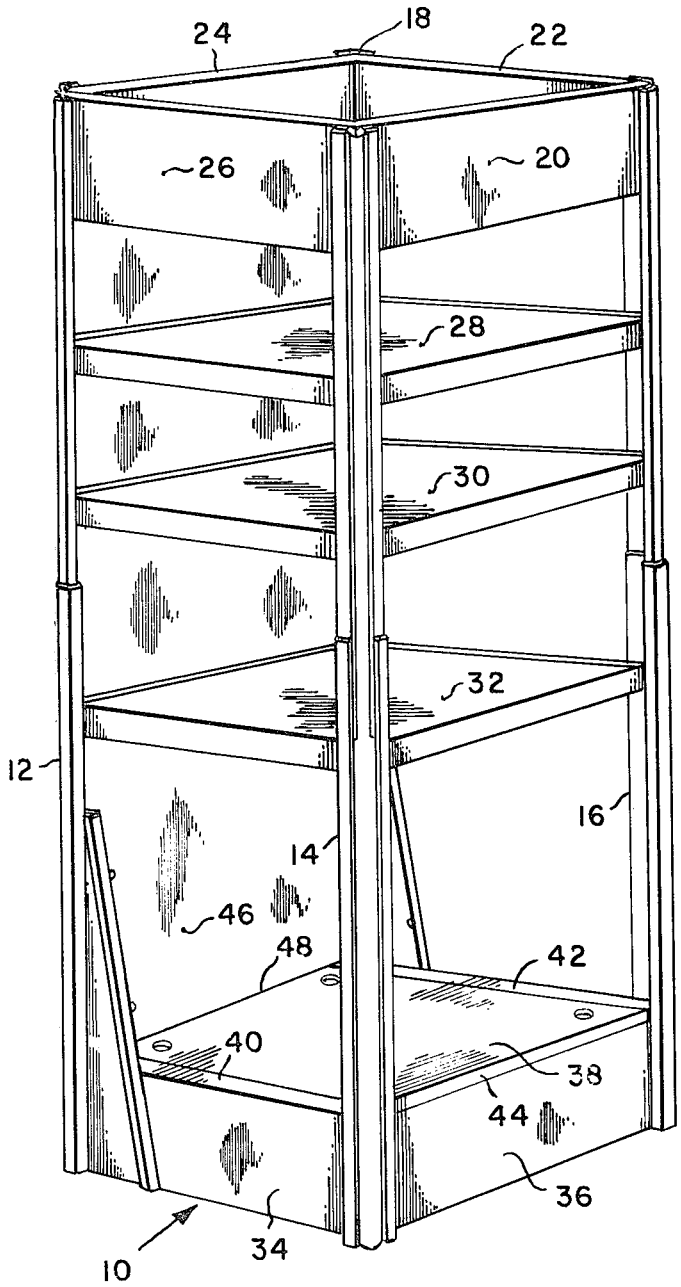
FIG. 1 is a perspective view of a merchandising display stand in accordance with the invention showing the base shelf in its horizontal position.

As shown in FIG. 1, the display stand comprises a base 10 having posts 12, 14, 16 and 18 extending upwardly from its four corners. A conventional canopy assembly comprising panels 20, 22, 24 and 26 is provided at the upper ends of the posts, and shelves 28, 30, and 32 are secured to the posts by the engagement of hooks formed in the shelves with slots formed in the posts. The display stand is preferably made substantially entirely from sheet metal. Except for the details of the base, the stand is substantially identical to the display stand described in the copending application of James Marshall Suttles, filed Jan. 29, 1980 under Ser. No. 116,585. The entire disclosure of the Suttles application is incorporated here by reference.

Whereas in the Suttles application, the base comprises a pair of side panels and a unit consisting of a horizontal article-support panel and front and rear panels depending from the article-support panel, the base of the present invention comprises a pair of side panels, front and rear panels, and a shelf removably mountable on the panels of the base structure. In FIG. 1, one of the side panels is shown at 34, and the front panel is shown at 36. The shelf 38 is shown with its article-supporting surface in a horizontal plane flush with inwardly projecting flange 40 at the top of side panel 34, and with a similar inwardly projecting flange 42 of the opposite side panel. Front edge flange 44 of shelf 38 is substantially flush with front panel 36. A vertical back panel is provided at 46, and the rear edge 48 of shelf 38 is positioned adjacent back panel 36, though it need not touch the back panel.

In the configuration shown in FIG. 1, the display stand is suitable for displaying individual bottles on all of the shelves, including shelf 38.

Figure 2:
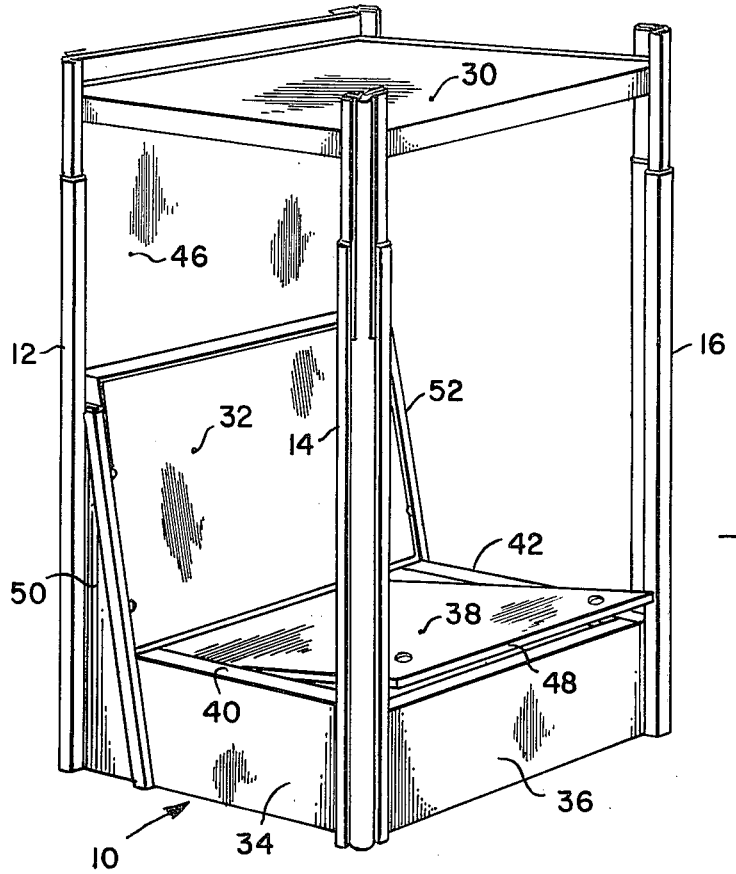
FIG. 2 is a perspective view of the lower part of the same stand showing the base shelf in its tilted condition.
Figure 3:
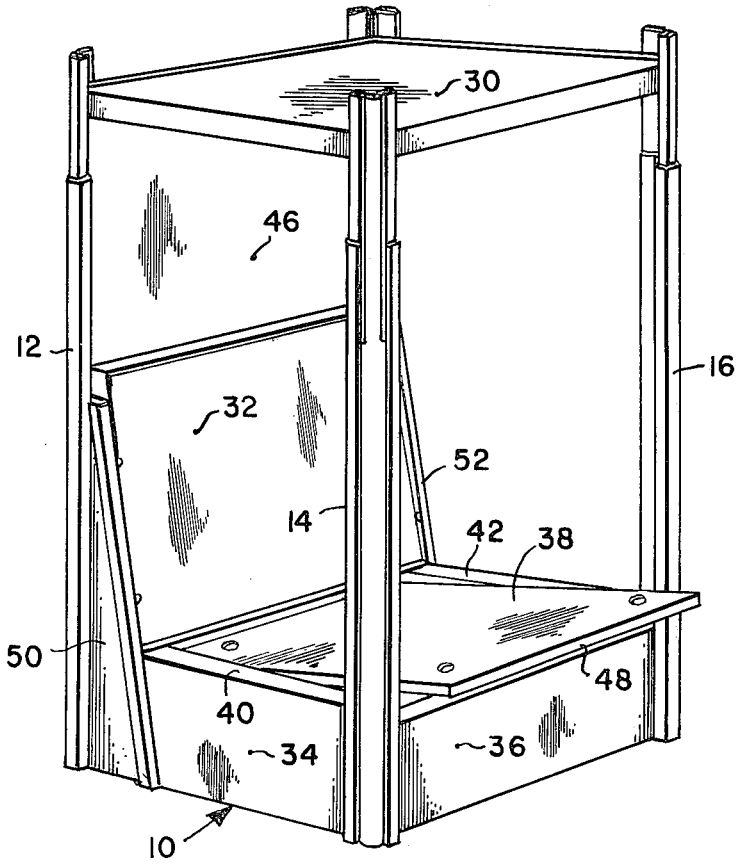
FIG. 3 is a perspective view of the same stand showing the base shelf tilted and in its forwardly extending condition.

When the display stand is to be used for displaying stacked packages along with individual bottles, shelf 32 is moved from its horizontal position to one of the positions shown in FIGS. 2 and 3. In FIG. 2, one edge of shelf 32 rests on side panel flanges 40 and 42, and the sides of shelf 32 are held between reinforcing brackets 50 and 52. Preferably, the surface of shelf 32 is at an angle of about seven degrees measured from vertical. Shelf 38 is reversed so that edge 48 is toward the front of the display stand. The article-supporting surface 38 is perpendicular to shelf 32, and at an angle of about seven degrees from horizontal.

In FIG. 3, shelf 32 is in the same position as in FIG. 2. Again, shelf 38 is tilted at an angle of seven degrees. However, it is moved fowardly, so that its edge 48 projects beyond posts 14 and 16, thereby providing a larger supporting area for stacks of soft drink cartons.

The manner in which the three positions of shelf 38 are achieved will now be described with reference to FIGS. 4–7.

Figure 4:
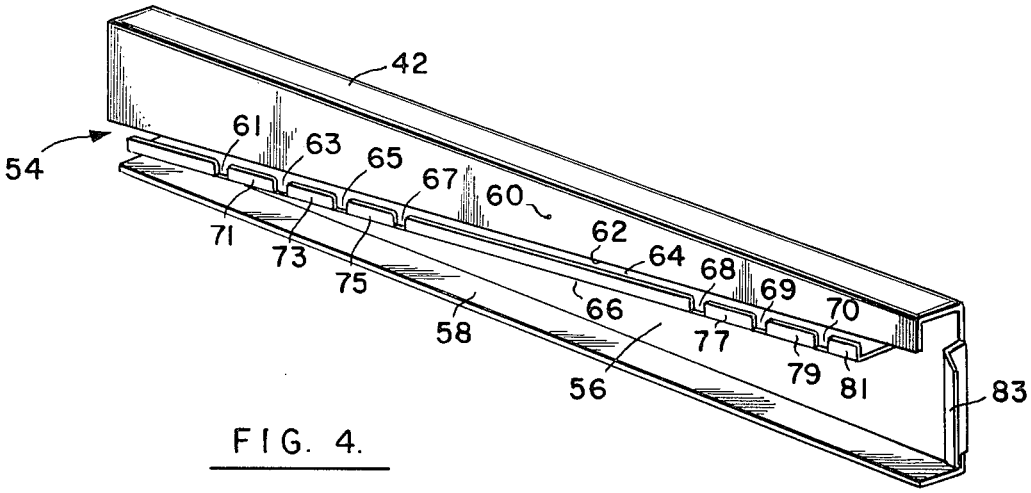
FIG. 4 is a perspective view showing one of the side panels of the base.

FIG. 4 shows the right-hand side panel 54 of the base. This side panel comprises a vertical plate 56 having an inwardly projecting flange 58 at its lower edge, and an inwardly projecting flange 42 at its upper edge. Depending from flange 42 is a triangular element 60 having a lower edge 62 disposed at an angle of approximately 3.5 degrees from horizontal. Flange 64 projects inwardly from edge 62 to provide one of two supporting surfaces for the shelf. A flange extending upwardly from edge 66 of flange 64 is slotted at 61, 63, 65, 67, 68, 69 and 70 to provide individual upwardly extending tabs 71, 73, 75, 77, 79 and 81. These tabs are used for locking the shelf in any desired one of several possible fore-and-aft positions. Preferably, the posts of the display stand (or the lower post sections in the case of two-part posts) are permanently welded to the side panels to produce U-shaped structures as described in the previously mentioned pending application of James Marshall Suttles. Clip 83 is formed at the front end of panel 54 and a similar clip (not seen in FIG. 4) is provided at the opposite end of the panel. These clips cooperate with the posts to provide pockets for securing the front and rear panels to the side panel. The manner in which these clips function, and the details of their construction are described in the pending Suttles application.

Side panel 34 (FIGS. 1–3) is a mirror image of side panel 54, and need not be described separately.

Figure 5:
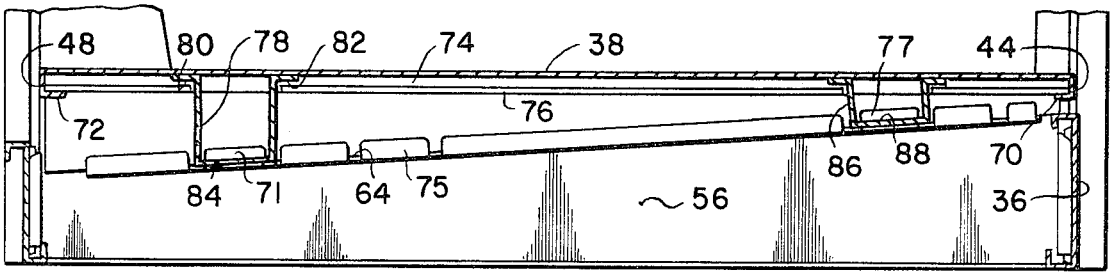
FIG. 5 is a sectional view taken on a vertical plane extending in the fore-and-aft direction, and showing the base shelf supported in its horizontal condition.

Shelf 38 is formed by providing downwardly projecting flanges on all four edges, and by securing reinforcing channels to the underside of the sheet. In FIG. 5, downwardly projecting flanges at the front and rear of the shelf are shown at front and rear edges 44 and 48. At the lower edges of these flanges, inwardly projecting flanges are provided at 70 and 72. A downwardly projecting flange 74 is provided at the far side of shelf 38 as viewed in FIG. 5, and flange 74 has at its lower edge an inwardly projecting flange 76. A similar flange (not shown) is provided at the near edge of the shelf. Flange 76 and its counterpart at the near edge of the shelf are cut away at two locations to provide for the U-shaped reinforcing channels.

Channel 78 is a U-shaped channel having flanges 80 and 82 welded to the underside of the shelf. Channel 78 extends from flange 74 to its counterpart on the near side of the shelf in parallel relation to front and rear edges 44 and 48. Channel 78 is formed in such a way that web-section 84 forms an angle of approximately 3.5 degrees with the article-supporting surface of the shelf. As shown in FIG. 5, web section 84 rests on support flange 64, and is provided with a slot to receive tab 71.

Figure 9:
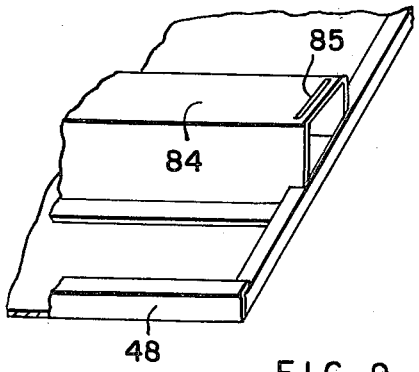
FIG. 9 is a fragmentary perspective showing a positioning slot at one end of a shelf reinforcing channel.

Each reinforcing channel is slotted at both of its ends in order to receive positioning tabs on the side panels. One such slot is shown in FIG. 9 at 85.

A similar channel 86 (FIG. 5) is welded to the underside of the shelf, and extends in parallel relation to the front and rear edges from one side edge to the other. Channel 86 is shorter than channel 78 in the vertical direction, and has a web section 88 which is coplanar with web section 84 of channel 78. Thus, web section 88 rests on one area of flange 64, while web section 84 rests on another area of flange 64. A slot in web section 88 receives tab 77. As the angle between web sections 84 and 88 and the article-supporting surface of the shelf is the same as the angle between flange 64 and the horizontal, the article-supporting surface is held horizontal.

Preferably, the two reinforcing channels are located on opposite sides of an imaginary midline extending parallel to front and rear shelf edges 44 and 48, and located midway between these edges. Positioning the reinforcing channels on opposite sides of the midline insures stability of the shelves. Desirably, for the most effective support, channel 78 is positioned about halfway between the midline and edge 48, while channel 86 is similarly positioned about halfway between the midline and front flange 44 of the shelf.

Figure 6:
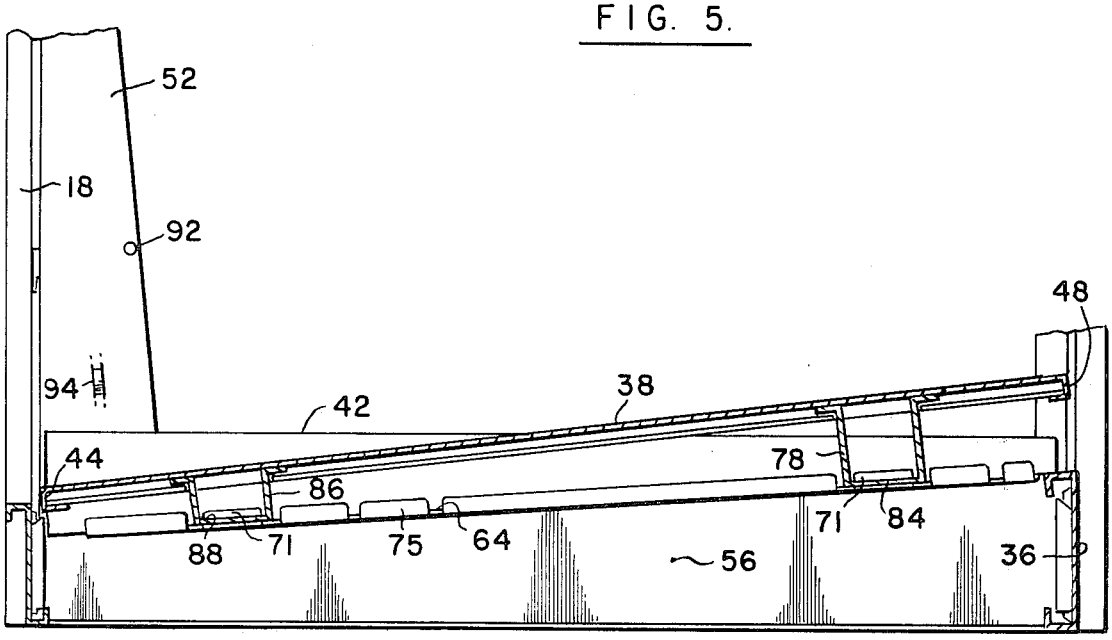
FIG. 6 is a vertical section showing the base shelf in its tilted condition.

By reversing the shelf so that flange 48 is toward the front and flange 44 is toward the back, the shelf may be positioned as shown in FIG. 6 with its article-supporting surface sloping at a seven degree angle. Web sections 84 and 88, being coplanar, both rest on inwardly projecting flange 64 of side panel 56. Tab 71 is received in a slot in web section 88 and tab 77 is received in a slot in web section 84 to lock the shelf against fore-and-aft movement. The 3.5 degree angle between the plane of the web sections and the article-supporting surface is added to the 3.5 degree angle between flange 64 and the horizontal, with the result that the article-supporting surface is disposed at a seven degree angle with respect to the horizontal.

From the foregoing, it will be apparent that merely by reversing the position of shelf 38, it can be made either horizontal or tilted as desired. It should be understood, of course, that the shelf cooperates in a similar manner with an inwardly projecting sloping flange (not shown) on side panel 34, which flange corresponds with, and is coplanar with flange 64.

Figure 7:
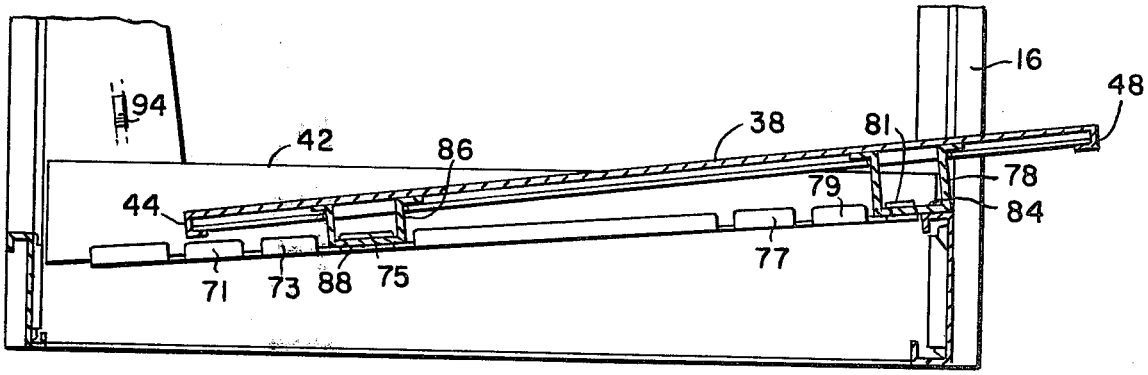
FIG. 7 is a vertical section showing the base shelf in its tilted and forwardly extending condition.

With the shelf in its sloping position, it can be engaged with the support either in the position illustrated in FIG. 6, or two alternative positions one of which is illustrated in FIG. 7. The slot in web section 88 is engaged with tab 75 rather than tab 71 and the slot in web section 84 is engaged with tab 81 rather than tab 77, so that edge 48 of shelf 38 projects forwardly beyond front posts 14 and 16. Reinforcing channel 78 should be positioned with respect to channel 86 so that web section 84 rests at least in part on flange 64 when the shelf is moved to its foremost position. Tabs 73 and 79 can be used to position the shelf in an intermediate position in a similar manner.

The forward positions of the shelf are useful to provide more support area for stacks of packages, which may be necessary depending upon the size and shape of the packages.

The shelf can also be moved forward in its horizontal condition by engaging the slots in the reinforcing channels with the intermediate or foremost tabs.

In one modification of the invention, more than six tabs can be used on each inwardly projecting side panel flange to provide still more choices of shelf positions. In still another modification, a single tab can be provided for each end of each reinforcing channel, and the positions of the reinforcing channels so chosen as to cause the forward edge of the shelf to be flush with the front base panel when the shelf is horizontal, while causing the front edge of the shelf to project forwardly beyond the base panel when the shelf is tilted. This can easily be accomplished, for example, by using only tabs 75 and 77 and their counterparts on the opposite side panel, vertically shortening channel 78 and locating the shortened channel so that its slot can engage tab 75 while the slot in channel 86 engages tab 77. Reversal of the shelf automatically causes the front edge of the shelf to protrude beyond the front posts.

Figure 8:
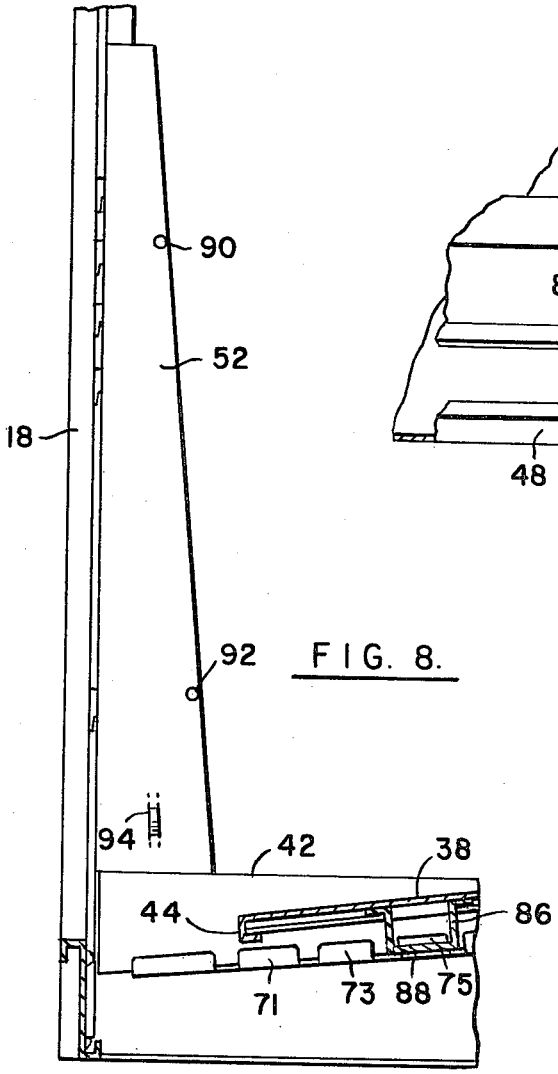
FIG. 8 is a fragmentary vertical section showing details of a triangular reinforcing bracket by which a post at the rear of the stand is secured to one of the side panels of the base.

Bracket 52 is peened to provide rounded projections 90 and 92 (FIG. 8) which serve to hold shelf 32 in place, when it is used as a sloping back panel. A projection is struck out of panel 52 at 94, and a side flange of the shelf rests against this projection. The upper ends of the side flanges of shelf 32 rest against the posts, and the face of the shelf is thereby held at a seven degree tilt. Projections 90, 92 and 94, together with corresponding projections on the opposite bracket 50 (FIGS. 2 and 3) hold the shelf panel in place by a snap-fit.

From the foregoing, it will be apparent that the invention provides a convertible base having many advantages, among which are superior strength, simplicity of construction, ease of adjustability and ease of manufacture. Other advantages not specifically mentioned include the fact that the side panels, which are the only structurally complex parts of the assembly, can be used in merchandisers of any desired width. This simplifies manufacture, since only the relatively simple parts such as the shelves and the front and rear panels have to be made in different sizes. Another advantage of the invention is the fact that the flanges of the side panels from which the tabs are formed also reinforce the sloping support flanges corresponding to flange 64 (FIGS. 4, 5 and 6). Consequently, even though the load on these support flanges is concentrated by reason of the narrowness of the webs of the reinforcing channels underneath the shelf, the weight of the articles on the shelf is prevented from deforming the sloping support flanges.

Various modifications other than those specifically suggested above will occur to those skilled in the art after having read the foregoing specification, and can be made without departing from the scope of the invention as defined in the following claims.

I claim:

1. A merchandising display stand comprising:

a base having a front and rear and shelf means having first and second opposite edges, the shelf means being removably mountable on the base and providing a substantially flat article-supporting surface, characterized by means on the base for supporting the shelf means, and means on the shelf means cooperable with the means on the base, for positioning the article-supporting surface in a first plane when the shelf means is mounted on the base with its first edge toward the front of the base, and for positioning the article-supporting surface in a second plane which intersects said first plane when the shelf means is mounted on the base with its first edge toward the rear of the base;

in which said base comprises a pair of side panels, in which the means on the base for supporting the shelf means comprises coplanar flange means formed on each side panel and projecting toward the other side panel, the flange means on each panel providing an upwardly facing supporting area disposed in an oblique plane, and in which the means on the shelf means cooperable with the means on the base comprises first and second U-shaped reinforcing channels extending in directions parallel to said first and second edges of the shelf, and secured to the underside of the shelf in spaced relationship to each other and on opposite sides of the midline between said first and second edges, the U-shaped channels having coplanar web sections disposed in a plane oblique with respect to the article-supporting surface, the ends of the coplanar web sections providing downwardly facing contact areas underneath the shelf means and adjacent the opposite side edges of the shelf means, each downwardly facing contact area being positioned for engagement with one of the flange means when the shelf means is mounted on the base with its first edge toward the front of the base, and with the other of said flange means when the shelf means is mounted with its first edge toward the rear of the base;

and having tabs fixed to and projecting upwardly from the flange means on each panel, and slot means formed in said downwardly facing contact areas, said slot means being arranged to receive said tabs and thereby lock the shelf against forward and rearward movement with respect to the base.

2. A merchandising display stand according to claim 1 having at least two tabs fixed to and projecting upwardly from the flange means of each panel, the tabs on each flange means being arranged one forward of the other, said slot means being arranged to receive selectively one or the other of the tabs on each flange means at least when the shelf means is mounted on the base with its first edge toward the rear of the base whereby the shelf means may be selectively locked against forward and rearward movement with respect to the base in first and second positions, said second edge of the shelf means, when the shelf means is in its second position, being forward of the position of said second edge when said shelf means is in its first position.

3. A merchandising display stand comprising:

a base having a front and rear and shelf means having first and second opposite edges, the shelf means being removably mountable on the base and providing a substantially flat article-supporting surface, characterized by means on the base for supporting the shelf means, and means on the shelf means cooperable with the means on the base, for positioning the article-supporting surface in a first plane when the shelf means is mounted on the base with its first edge toward the front of the base, and for positioning the article-supporting surface in a second plane which intersects said first plane when the shelf means is mounted on the base with its first edge toward the rear of the base;

in which said base comprises a pair of opposed, unitary, sheet metal side panels, each having a first inwardly projecting flange, a triangular element depending from said first flange and a second flange projecting inwardly from the lower edge of said triangular element;

said second flanges providing an upwardly facing support area disposed in an oblique plane and constituting said means for positioning the article-supporting surface;

in which said means on the shelf means cooperable with the means on the base comprises means providing downwardly facing contact areas underneath the shelf means and adjacent the opposite side edges of the shelf means, each downwardly facing contact area being positioned for engagement with one of the second flanges when the shelf means is mounted on the base with its first edge toward the front of the base, and with the other of said second flanges when the shelf means is mounted with its first edge toward the rear of the shelf;

and in which said first inwardly projecting flanges are located in said first plane and are flush with said article-supporting surface when the shelf means is mounted on the base with its first edge toward the front of the base.

* * * * *